United States Patent [19]

Piontkowski

[11] 4,033,390

[45] July 5, 1977

[54] WOOD SPLITTER

[75] Inventor: Carl Piontkowski, Old Saybrook, Conn.

[73] Assignee: C & D. Distributors, Inc., Old Saybrook, Conn.

[22] Filed: Feb. 2, 1976

[21] Appl. No.: 654,636

[52] U.S. Cl. ..... 144/193 D; 144/193 R; 254/104

[51] Int. Cl.[2] ..... B27L 7/00

[58] Field of Search ..... 254/104; 144/193 R, 144/193 A, 193 D, 193 E, 193 F, 193 J, 193 K, 3 K, 309 R

[56] References Cited

UNITED STATES PATENTS 720,010 2/1903 Eiden ..... 144/193 C

*Primary Examiner*—Othell M. Simpson
*Assistant Examiner*—W. D. Bray
*Attorney, Agent, or Firm*—McCormick, Paulding & Huber

[57] ABSTRACT

A wood splitting wedge is arranged on a vertical support such that the upper end of the wedge can be conveniently struck by a sledge hammer or the like in order to split a log provided immediately below the wedge and supported on a base which also serves to support the lower end of the support or standard. A second wedge is provided intermediate the first wedge and the standard and a handle serves to provide a convenient means for splitting small kindling with the second wedge. The second wedge serves the added function of spreading the sections of larger logs when they are being split in order to avoid jamming of the first wedge.

9 Claims, 4 Drawing Figures

WOOD SPLITTER

This invention relates generally to log splitting devices and deals more particularly with a relatively inexpensive wood splitter such that the splitter can be conveniently used with a conventional sledge hammer or the like, or such that the device can be conveniently used for splitting small kindling without the use of such a sledge hammer.

The general object of the present invention is to provide a wood splitting device of the type which can be readily used next to a fireplace or stove, and which device can be conveniently carried by the user, a handle being provided for this purpose, which handle also serves to permit use of the device in splitting small kindling or the like.

DETAILED DESCRIPTION

Figure 2:
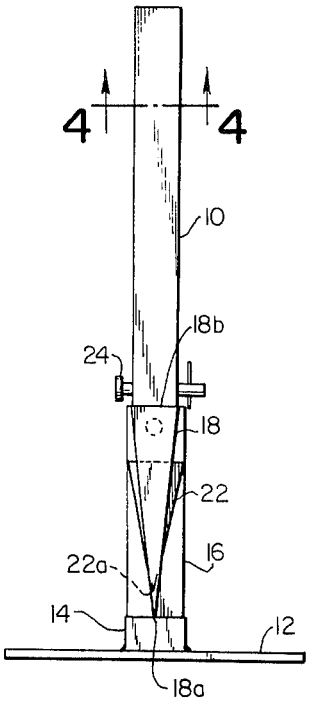
FIG. 2 is a front elevational view of the device illustrated in FIG. 1.

Turning now to the drawing in greater detail, a generally rectangular tube 10 is provided in an upright orientation with its lower end secured to a generally horizontally extending base 12. The base 12 has a generally rectangular stop or collar member 14 welded thereto and the upright standard or post 10 can be detachably connected to the collar by bolts or the like or it can be welded to the collar 14 in any event to provide a very rugged structure suitable for supporting wedge means constructed in accordance with the present invention.

Figure 1:
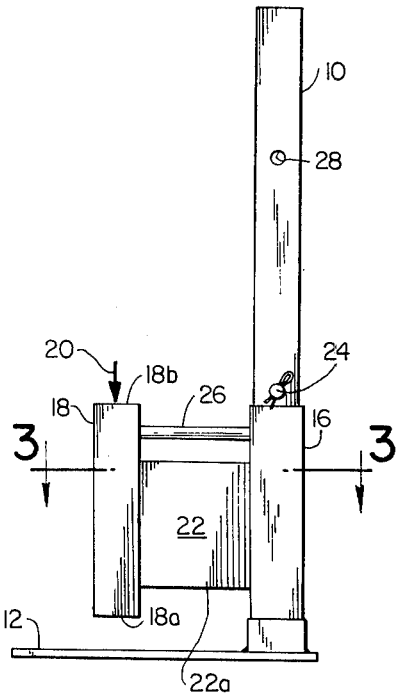
FIG. 1 is an elevational view illustrating a preferred form of the present invention.

In its presently preferred form, the wedge means includes an elongated tubular portion 16 of non-circular shape slidably received on the rectangular standard or post 10, and a tapered downwardly pointed wedge member 18 which is mounted in forwardly spaced relationship to the elongated tubular portion 16 such that the upwardly facing, or top surface **18*b* of the wedge member 18 can be struck with a sledge hammer or the like as indicated generally by the arrow 20 of FIG. 1. In so using the device of FIG. 1 the wedge means is raised, by the handle 26, and a log placed with its lower end on the upwardly facing surface of the base 12 and its upper end is engaged by the lower chisel edge 18*a* of the wedge member 18. As so arranged striking the upper surface 18*b* of the wedge member 18** can be readily accomplished. As so operated the device is safe enough to permit splitting of logs adjacent the fireplace area in a home.

It is an important feature of the present invention that the wedge member 18 is provided in forwardly spaced relationship to the longitudinal axis of the upright standard or post 10, and the means for so orienting the wedge member 18 preferably comprises a bracket structure including a second wedge member 22, which second wedge member 22 is also of downwardly tapered configuration and terminates in a pointed lower chisel edge **22*a*. It will be noted from FIG. 2 that the included angle of the second wedge member 22 is slightly greater than that of the primary or lead wedge member 18. It should also be noted that the lower chisel edge 22*a* of the second wedge member 22 is spaced vertically above the lower chisel edge 18*a* of the first mentioned wedge member 18 so that its chisel edge 22*a* does not interfere with use of the primary chisel edge 18*a*** in the splitting of logs.

Not only does the second wedge member 22 not interfere with the splitting of such logs, but it is noted that the larger included angle of the second wedge member serves the purpose of holding the two halves of such logs in a spread-apart configuration such that the first mentioned wedge member 18 will not tend to bind up in the log during the splitting operation achieved as a result of striking the upwardly facing abutment surface **18*b* of such primary wedge member 18. It is further noted that the lower pointed chisel edges of both wedge members 22 and 18 reside in a common vertical plane which plane also includes the longitudinal axis of the standard or post member 10. Thus, and as best shown in FIG. 2, the device of the present invention is symmetrical when viewed from the front except for the use of a locking pin member 24** to be described.

Figure 3:
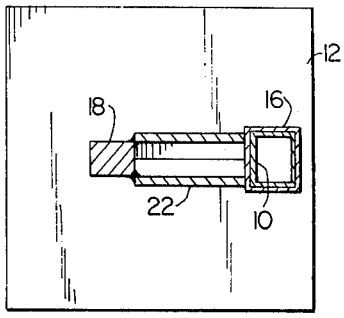
FIG. 3 is a sectional view taken generally on the line 3—3 of FIG. 1.
Figure 4:
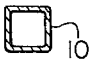
FIG. 4 is a sectional view taken generally on the line 4—4 of FIG. 2.

Turning next to a detailed description of FIG. 3, the primary or first wedge member 18 can be seen from this view to comprise a solid chisel element, preferably of hardened steel, whereas the somewhat fatter second chisel member 22 is fabricated from welded pieces of sheet metal, although it could of course comprise a weighted member such that the overall wedge means might be made proportionately heavier in the event that somewhat heavier logs were to be split in the manner described above.

Finally, and still with reference to the bracket structure which supports the primary wedge member 18 in spaced relationship forwardly of the post 10, a handle 26 extends from a point just below the upper abutment end of the first wedge member, generally rearwardly, to connect said first wedge member with the hollow tubular portion 16, and said handle serves to define a finger space between the handle and the upper end of the second wedge member in order to permit the wedge means to be conveniently raised from the position shown after removal of the locking pin 24. As so constructed and arranged the second wedge member 22 can be conveniently used for splitting small kindling wood or the like in a second mode of operation for the device which does not require use of a sledge or the like.

In the position shown for the wedge means in FIGS. 1 and 2, the lifting handle 26 can be conveniently used in order to transport the wood splitter from one position to another. Removal of the locking pin 24 permits the wedge means to be raised conveniently by the lifting handle so that kindling wood can be split as discussed in the preceding paragraph, and so a log can be placed between the base 12 and the lower chisel edge **18*a* of the primary wedge member 18** in order to permit striking the wedge member as described previously.

In the event that a log does become bound with the wedge means during the latter mode, it will be desirable to position the wedge means in a raised position with the locking pin 24 in a hole 28 provided for it. In such a position, that is raising of the wedge means and insertion of the locking pin 24 in the upper hole 28 with the wedge means being thereby supported in its raised or upper position (not shown) the log can be struck from above directly by the sledge to free the wedge means therefrom.

Still with reference to the various locations of the wedge means on the standard or post 10, it is noted that the collar 14 provided on the base 12 defines a stop position for limiting the downward movement of the wedge means and thereby preventing damage to the chisel edge 18*a* when the device is used or splitting either kindling wood or large logs as described.

I claim:

1. A device for splitting logs or the like, and comprising a horizontally extending base for supporting a log to be split in a generally upright orientation, a fixed post carried by the base and extending upwardly therefrom, wedge means slidably mounted on said post for movement toward and away from said base, said wedge means including an elongated sleeve slidably received on said post and a tapered downwardly pointed wedge member spaced from the sleeve, said wedge member having an upwardly facing abutment surface adapted to be struck to drive the lower chisel edge of said wedge member into the log, said wedge means further including bracket means connecting said wedge member to said sleeve and a second wedge member also of downwardly tapered configuration and having a pointed lower chisel edge which defines an included angle slightly greater than that defined by said first mentioned wedge member.

2. The combination defined in claim 1 wherein said second wedge member has an upper end which is wider than that of said first wedge member.

3. The combination defined in claim 1 wherein said second wedge member has its pointed lower chisel edge spaced above that of said first wedge member, both said lower pointed chisel edges residing in a common vertical plane.

4. The combination defined in claim 3 wherein said second wedge member has an upper end which is wider than that of said first wedge member.

5. The combination defined in claim 3 wherein said bracket means further includes a handle portion extending from a point just below the upper abutment surface of said first wedge member toward said sleeve to connect said first wedge member with said sleeve and defining a space between said handle and the upper end of said second wedge member.

6. The combination defined in claim 5 wherein said post is of generally non-circular cross section, and said sleeve is non-rotatably but slidably received thereon.

7. The combination defined in claim 5 wherein said second wedge member has an upper end which is wider than that of said first wedge member.

8. The combination defined in claim 6 further characterized by removable stop pin means associated with said post to hold the wedge means in a predetermined vertical position relative to said base.

9. The combination defined in claim 8 further characterized by stop means to limit the down position of said wedge means and prevent contact between said first wedge chisel edge and said base.

* * * * *